US011266884B2

(12) United States Patent
Shimahara

(10) Patent No.: US 11,266,884 B2
(45) Date of Patent: Mar. 8, 2022

(54) IRON-TYPE GOLF CLUB HEAD AND GOLF CLUB SET PROVIDED THEREWITH

(71) Applicant: DUNLOP SPORTS CO. LTD., Kobe (JP)

(72) Inventor: Yuki Shimahara, Kobe (JP)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 434 days.

(21) Appl. No.: 14/915,010

(22) PCT Filed: Jun. 9, 2014

(86) PCT No.: PCT/JP2014/065206

§ 371 (c)(1),
(2) Date: Feb. 26, 2016

(87) PCT Pub. No.: WO2015/029538

PCT Pub. Date: Mar. 5, 2015

(65) Prior Publication Data

US 2016/0199704 A1 Jul. 14, 2016

(30) Foreign Application Priority Data

Aug. 30, 2013 (JP) ..... JP2013-180569

(51) Int. Cl.
*A63B 53/04* (2015.01)
*A63B 53/00* (2015.01)

(52) U.S. Cl.
CPC ..... *A63B 53/00* (2013.01); *A63B 53/047* (2013.01); *A63B 53/005* (2020.08); *A63B 53/0433* (2020.08)

(58) Field of Classification Search
CPC ..... A63B 2053/0433; A63B 2053/005
(Continued)

(56) References Cited

U.S. PATENT DOCUMENTS 3,088,736 A * 5/1963 Mospan ..... A63B 53/04 473/314
3,897,065 A * 7/1975 Solheim ..... A63B 53/04 473/349

(Continued)

FOREIGN PATENT DOCUMENTS

JP 64-80378 A 3/1989
JP 2-63483 A 3/1990

(Continued)

OTHER PUBLICATIONS

Chinese Office Action and Search Report, dated Mar. 28, 2017, for Chinese Application No. 201480046683.2, as well as an English translation.

(Continued)

*Primary Examiner* — William M Pierce
(74) *Attorney, Agent, or Firm* — Birch, Stewart, Kolasch & Birch, LLP

(57) ABSTRACT

The present invention provides an iron-type golf club head that is able to increase the amount of backspin while reducing resistance against the ground, and a golf club set. In an iron-type golf club head having a top surface, a sole surface, a toe surface that connects therebetween, and a face surface that hits a ball, the sole surface is provided with a leading surface sloping to a face side and a trailing surface sloping to a back side in a face-back direction, with a visible boundary line extending in a toe-heel direction as an apex.

11 Claims, 9 Drawing Sheets

(58) Field of Classification Search
USPC ..... 473/328, 344
See application file for complete search history.

(56) References Cited

U.S. PATENT DOCUMENTS 4,854,580 A * 8/1989 Kobayashi ..... A63B 53/04 473/290
4,867,457 A * 9/1989 Lowe ..... A63B 53/0487 473/341
4,938,470 A * 7/1990 Antonious ..... A63B 53/04 473/242
5,295,685 A * 3/1994 Solheim ..... A63B 53/04 473/350
5,301,944 A * 4/1994 Koehler ..... A63B 53/04 473/328
5,377,983 A * 1/1995 Fenton ..... A63B 53/04 473/328
5,429,353 A * 7/1995 Hoeflich ..... A63B 53/04 473/350
5,549,296 A * 8/1996 Gilbert ..... A63B 53/04 473/290
5,813,919 A * 9/1998 Best ..... A63B 53/04 473/290
5,971,866 A * 10/1999 Adams ..... A63B 53/04 473/328
6,093,113 A * 7/2000 Mertens ..... A63B 53/04 473/328
6,251,029 B1 * 6/2001 Roberts ..... A63B 53/04 473/328
6,471,601 B1 * 10/2002 McCabe ..... A63B 53/047 473/290
6,482,104 B1 * 11/2002 Gilbert ..... A63B 53/04 473/287
6,569,029 B1 * 5/2003 Hamburger ..... A63B 53/047 473/238
6,695,714 B1 * 2/2004 Bliss ..... A63B 53/047 473/328
7,442,130 B2 * 10/2008 Ban ..... A63B 53/00 473/290
D581,000 S * 11/2008 Nicolette ..... D21/749
7,614,962 B1 * 11/2009 Clausen ..... A63B 53/047 473/291
7,824,277 B2 * 11/2010 Bennett ..... A63B 53/0466 473/328
D643,492 S * 8/2011 Nicolette ..... D21/759
8,083,607 B2 * 12/2011 Clausen ..... A63B 53/047 473/291
8,133,129 B2 * 3/2012 Boyd ..... A63B 53/047 473/288
8,753,230 B2 * 6/2014 Stokke ..... A63B 53/047 473/350
8,961,336 B1 * 2/2015 Parsons ..... A63B 53/0475 473/332
9,079,080 B2 * 7/2015 Jertson ..... A63B 53/047
9,878,219 B2 * 1/2018 Shimahara ..... A63B 53/047
9,956,461 B2 * 5/2018 Shimahara ..... A63B 53/047
10,105,580 B2 * 10/2018 Shimahara ..... A63B 53/047
2002/0065140 A1 * 5/2002 Iwata ..... A63B 53/04 473/291
2007/0054751 A1 * 3/2007 Breier ..... A63B 53/04 473/334
2007/0149305 A1 * 6/2007 Ban ..... A63B 53/00 473/290
2008/0058119 A1 * 3/2008 Soracco ..... A63B 53/04 473/350
2009/0023513 A1 * 1/2009 Shibata ..... A63B 53/047 473/305
2010/0041493 A1 * 2/2010 Clausen ..... A63B 53/047 473/291
2011/0207551 A1 * 8/2011 Breier ..... A63B 53/047 473/332
2012/0157222 A1 * 6/2012 Kii ..... A63B 53/00 473/290
2012/0196702 A1 * 8/2012 Shimazaki ..... A63B 53/047 473/345
2013/0165251 A1 * 6/2013 Jorgensen ..... A63B 53/06 473/328
2013/0281227 A1 * 10/2013 Roach ..... A63B 53/0475 473/332
2013/0331201 A1 * 12/2013 Wahl ..... A63B 53/0475 473/329
2014/0073447 A1 * 3/2014 Golden ..... A63B 53/047 473/291
2014/0274441 A1 * 9/2014 Greer ..... A63B 53/047 473/290
2015/0321055 A1 * 11/2015 Golden ..... A63B 53/0466 473/338
2015/0328506 A1 * 11/2015 Morales ..... A63B 53/047 473/331
2016/0059093 A1 * 3/2016 Nielson ..... A63B 53/02 473/338

FOREIGN PATENT DOCUMENTS

JP 7-14424 B2 2/1995
JP 7-31696 A 2/1995
JP 2001-252380 A 9/2001
JP 2005-73780 A 3/2005
JP 2005073780 A * 3/2005
JP 2005-211560 A 8/2005
JP 2007175119 A * 7/2007 ..... A63B 53/00
JP 2008-35984 A 2/2008
JP 2008-194335 A 8/2008
JP 4525302 B2 8/2010
JP 4855967 B2 * 1/2012
JP 2013-161 A 1/2013

OTHER PUBLICATIONS

Japanese Office Action and English translation thereof, dated Mar. 28, 2017, for Japanese Application No. 2013-180569.
International Search Report, issued in PCT/JP2014/065206, dated Sep. 2, 2014.
Office Action issued in Korean Patent Application No. 10-2016-7004336 dated Sep. 29, 2020.

* cited by examiner

IRON-TYPE GOLF CLUB HEAD AND GOLF CLUB SET PROVIDED THEREWITH

TECHNICAL FIELD

The present invention relates to an iron-type golf club head and a golf club set provided therewith.

BACKGROUND ART

Heretofore, various proposals have been made in relation to iron-type golf clubs in order to improve the amount of backspin. For example, in Patent Literature 1, a protruding portion is provided on a sole part of an iron-type golf club. When the golf club is swung, the golf club head is displaced in a direction that reduces the loft angle due to the resistance that occurs when the protruding portion contacts the ground. Backspin is thereby imparted to the golf ball due to a gear effect. This backspin is in the same direction as the backspin that is imparted according to the loft angle, increasing the amount of backspin as a result.

CITATION LIST

Patent Literature

Patent Literature 1: JP 4525302

SUMMARY OF INVENTION

Technical Problem

However, with such a golf club head, provision of the protruding portion excessively increases resistance against the ground, possibly resulting in a decrease in swing speed as well as a decrease in low-drag performance for swinging the club through the ball. Also, even with a golf club head in which such a protruding portion is not provided, it is possible that, in the case where the sole surface is formed with an arced convex surface, for example, resistance similar to that noted above could occur due to the convex surface. The present invention was made in order to solve the above problems, and an object of invention is to provide an iron-type golf club head that is able to increase the amount of backspin while reducing resistance against the ground, and a golf club set.

Solution to Problem

The present invention is an iron-type golf club head having a top surface, a sole surface, a toe surface that connects therebetween, and a face surface that hits a ball, the sole surface including a leading surface that slopes to a face side and a trailing surface that slopes to a back side in a face-back direction, with a visible boundary line extending in a toe-heel direction as an apex.

In the above golf club head, the leading surface and the trailing surface can be formed as planar surfaces.

In any of the above golf club heads, the apex of the sole surface constituting the boundary line can be configured to have a protruding height that decreases from a central portion of the sole surface toward the toe side and the heel side.

In any of the above golf club heads, a central part of the boundary line can be formed to be convex toward the face side.

A first golf club set according to the present invention is a golf club set having three or more golf clubs that have different loft angles and include any of the above iron-type golf club heads, a width of the leading surface in the face-back direction increasing, the smaller the loft angle of the golf club.

A second golf club set according to the present invention is a golf club set having three or more golf clubs that have different loft angles and include any of the above iron-type golf club heads, an angle formed by the horizontal surface and the leading surface decreasing, the smaller the loft angle of the golf club, in a reference state in which the golf club head of each of the golf clubs is placed on a horizontal surface.

Advantageous Effects of Invention

The following effects can be obtained with a golf club head according to the present invention. First, with a typical iron-type golf club head, the sole surface is formed by an arced convex surface, and thus when the golf club is swung, a large area contacts the ground, increasing resistance. Swing speed thereby also decreases. Also, there is a problem in that even after the apex of the convex surface has passed beyond the ground, the resistance that occurs when the club is swung through the ball remains as before due to the convex shape, resulting in a decrease in low-drag performance.

As such, with a golf club head according to the present invention, the sole surface is provided with a leading surface sloping to the face side and a trailing surface sloping to the back side in the face-back direction, with a boundary line extending in the toe-heel direction as the apex, enabling effects such as the following to be obtained. That is, since a leading surface sloping from the apex of the sole surface, rather than a convex surface, is formed up to the apex, resistance with the ground when starting the swing can be reduced, enabling a decrease in swing speed to be suppressed. Also, since the resistance can be received mostly at the apex, which is the intersecting portion between the leading surface and the trailing surface, the head can be displaced at once in a direction that reduces the loft angle at this point. As a result, an efficient and stable gear effect can be obtained, enabling the amount of backspin of the ball to be increased.

Thus, with the golf club head according to the present invention, the gear effect can be efficiently obtained by the sole surface focusing the point at which resistance is received. That is, in the case where the sole surface is formed with a convex surface, resistance is received with the entire sole surface, as a result of which resistance is distributed, preventing a stable gear effect from being obtained as well as preventing the amount of backspin obtained from stabilizing, whereas in the present invention, these problems can be solved, as described above. Also, since a trailing surface sloping from the apex, rather than a convex surface, is formed in the back direction from the apex, resistance that occurs when swinging the club through the ball can be reduced and low-drag performance can be improved, even after the apex of the sole surface has passed beyond the ground.

Also, the following effects can be obtained with the first golf club set according to the present invention. For example, when the leading surface is wide in the face-back direction, it takes longer for the apex of the sole surface to contact the ground after the edge portion of the sole surface opposes the ground during the swing. The time until the gear effect occurs during the swing thereby increases. Here, because of the long contact time between the ball and the face surface in the case of a club such as a long iron with a small loft angle, it preferably takes a longer time for the gear effect to occur. On the other hand, because of the short contact time between the ball and the face surface in the case of a club such as a short iron with a large loft angle, it preferably takes a shorter time for the gear effect to occur. With the golf club set according to the present invention, the width of the leading surface in the face-back direction increases, the smaller the loft angle of the golf club, thus taking advantage of the characteristics of long irons and short irons noted above, and enabling the gear effect to be produced at an appropriate timing.

Also, the second golf club set according to the present invention is configured such that, in a reference state in which the golf club head of each golf club is placed on a horizontal surface, the angle formed by the horizontal surface and the leading surface decreases, the smaller the loft angle of the golf club. For example, with short irons, the amount of backspin is greater than long irons since the loft angle is larger, although a large gear effect needs to be obtained in order to realize this effect more markedly. Thus, an increased gear effect can be expected if the displacement of the head increases when the apex of the sole surface contacts the ground. As such, as noted above, displacement of the head in a direction that decreases the loft angle can be increased when a configuration is adopted in which the angle formed by the horizontal surface and the leading surface decreases, the smaller the loft angle of the golf club. Thus, a high gear effect can be obtained and the amount of backspin can be increased.

REFERENCE SIGNS LIST

Figure 1:
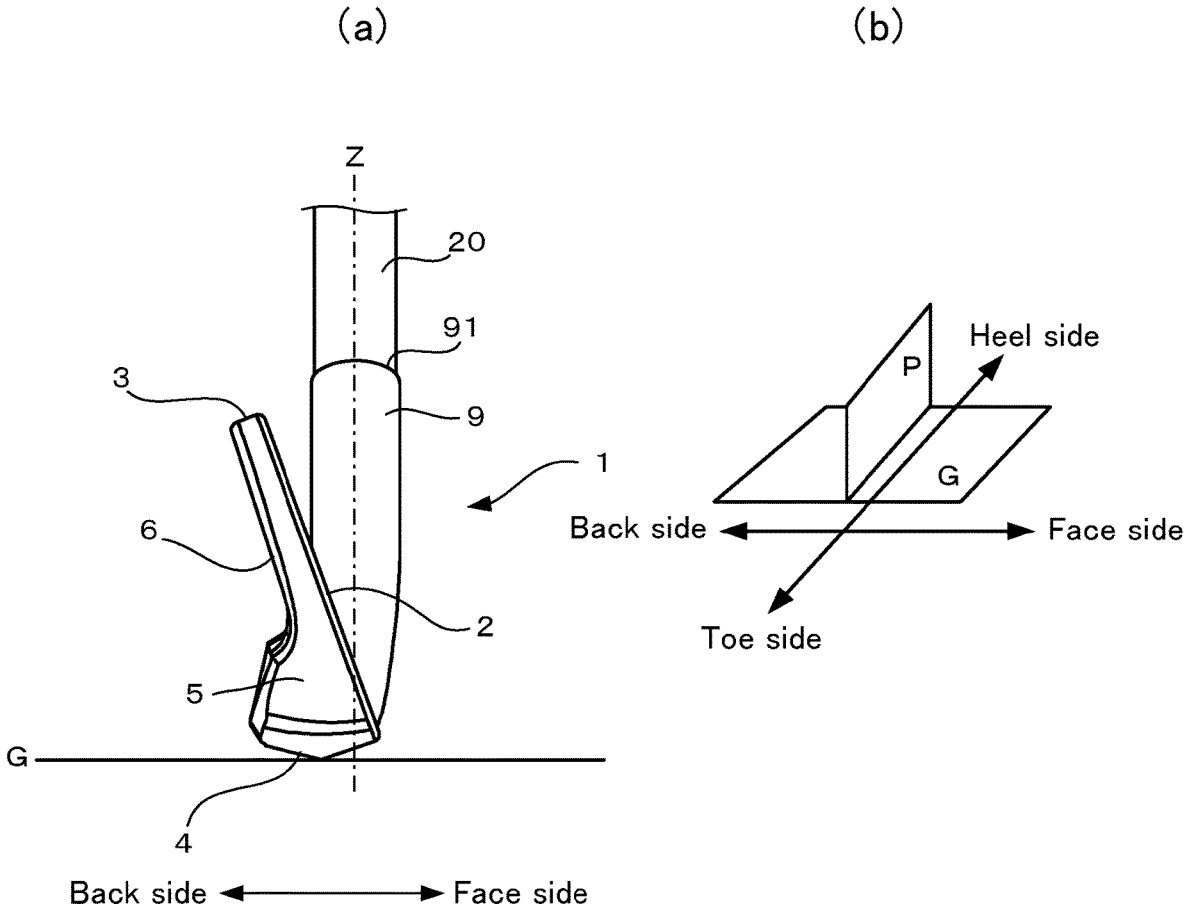
FIG. 1 is a side view of a reference state in which an iron-type golf club head 1 contacts ground G at a prescribed lie angle and a prescribed loft angle (both not shown).

1 Golf club head
2 Face surface
3 Top surface
4 Sole surface
41 Boundary line (apex)
42 Leading surface
43 Trading surface
5 Toe surface
9 Hosel part
50 Center of gravity of head 1

DESCRIPTION OF EMBODIMENTS

Figure 2:
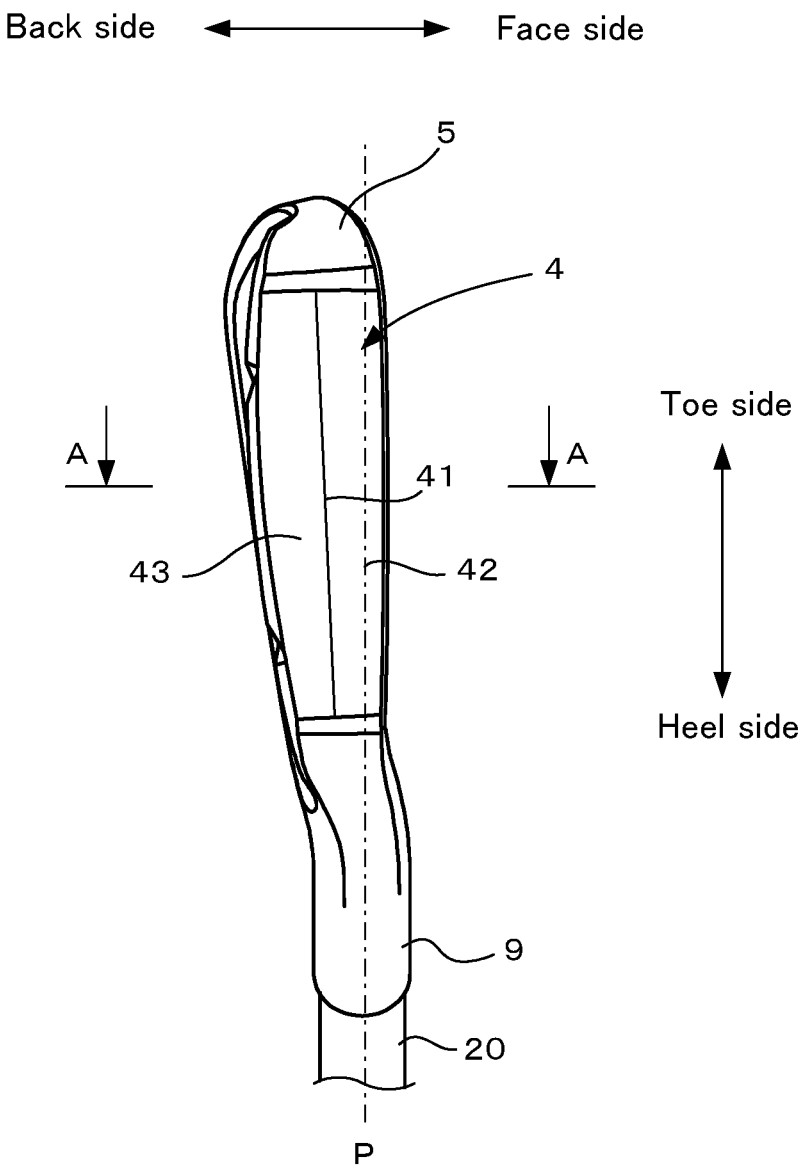
FIG. 2 is a bottom view of the golf club head of FIG. 1 as seen from the underside.

Hereinafter, a golf club head according to one embodiment of the present invention will be described with reference to drawings. FIG. 1 is a side view of a reference state in which an iron-type golf club head 1 is brought in contact with ground G at a prescribed lie angle and a prescribed loft angle (both not shown), and FIG. 2 is a bottom view of the golf club head of FIG. 1 as seen from the underside. Note that, in the present embodiment, description will be given taking a 3 iron-type golf club head as an example.

1. Structure of Golf Club Head

As shown in FIGS. 1 and 2, the iron-type golf club head (hereinafter, may be referred to simply as "head" or "club head") 1 according to the present embodiment is provided with a face surface 2 that hits the ball, a top surface 3 that is continuous with the top edge of the face surface 2 and forms a head upper surface, a sole surface 4 that is continuous with the bottom edge of the face surface 2 and forms a head lower surface, a toe surface 5 that curves smoothly and connects between the top surface 3 and the sole surface 4, and a back surface 6 that forms the surface on the opposite side to the face surface 2. Also, a hosel part 9 having a shaft insertion hole 91 for mounting a shaft 20 is provided at an opposite end of the top surface 3 to the toe surface 5. A center axis Z of this insertion hole 91 coincides with the axis of the shaft 20.

Here, the above-mentioned reference state will be described. First, as shown in FIGS. 1 and 2, the reference state is defined as a state in which the center axis Z is contained in a plane P (see FIG. 1(*b*)) that is perpendicular to a horizontal surface (ground G) and the head 1 is placed on the ground G at a predetermined lie angle and a predetermined real loft angle. The plane P is referred to as a reference perpendicular plane P. Also, the direction of an intersecting line of the reference perpendicular plane P and the ground G is referred to as a toe-heel direction, and the direction perpendicular to this toe-heel direction and parallel to the ground G is referred to as a face-back direction.

The head 1 of the present embodiment is constituted by a face plate made of a metal material as the face surface, and a head main body made of a different metal material from this face plate and having the face plate arranged as a front surface. The head 1 may, however, be formed by forging or casting one type of metal material.

Figure 3:
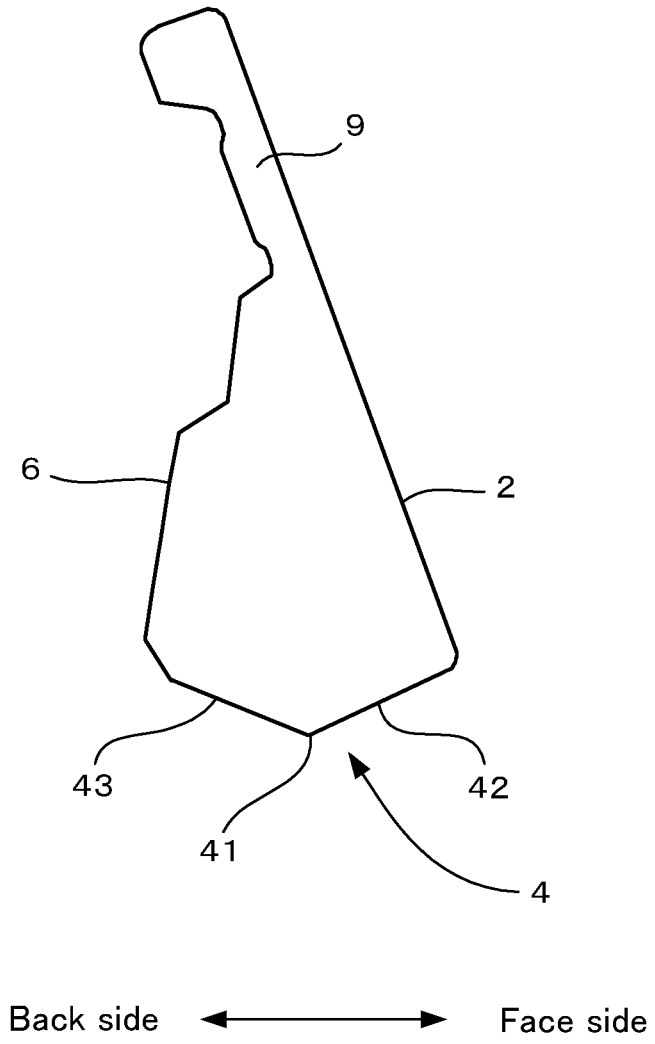
FIG. 3 is a cross-sectional view along a line A-A in FIG. 2.

Next, the sole surface 4 of this golf club head will be described, with reference also to FIG. 3. FIG. 3 is a cross-sectional view along a line A-A of FIG. 2. Although the sole surface 4 according to the present embodiment curves slightly in the toe-heel direction, a leading surface 42 is formed on the face side and a trailing surface 43 is formed on the back side, with a boundary line 41 extending linearly in the toe-heel direction near the center of the sole surface 4 in the face-back direction as the apex, as shown in FIG. 3. The leading and trailing surfaces are constituted by planar sloping surfaces respectively extending to the face side and back side from the boundary line 41. The cross-sectional shape of the sole surface 4 is thus peaked with the boundary line 41 as the apex, and the boundary line 41 forms a visible line.

2. Features of Golf Club Head

Figure 4:
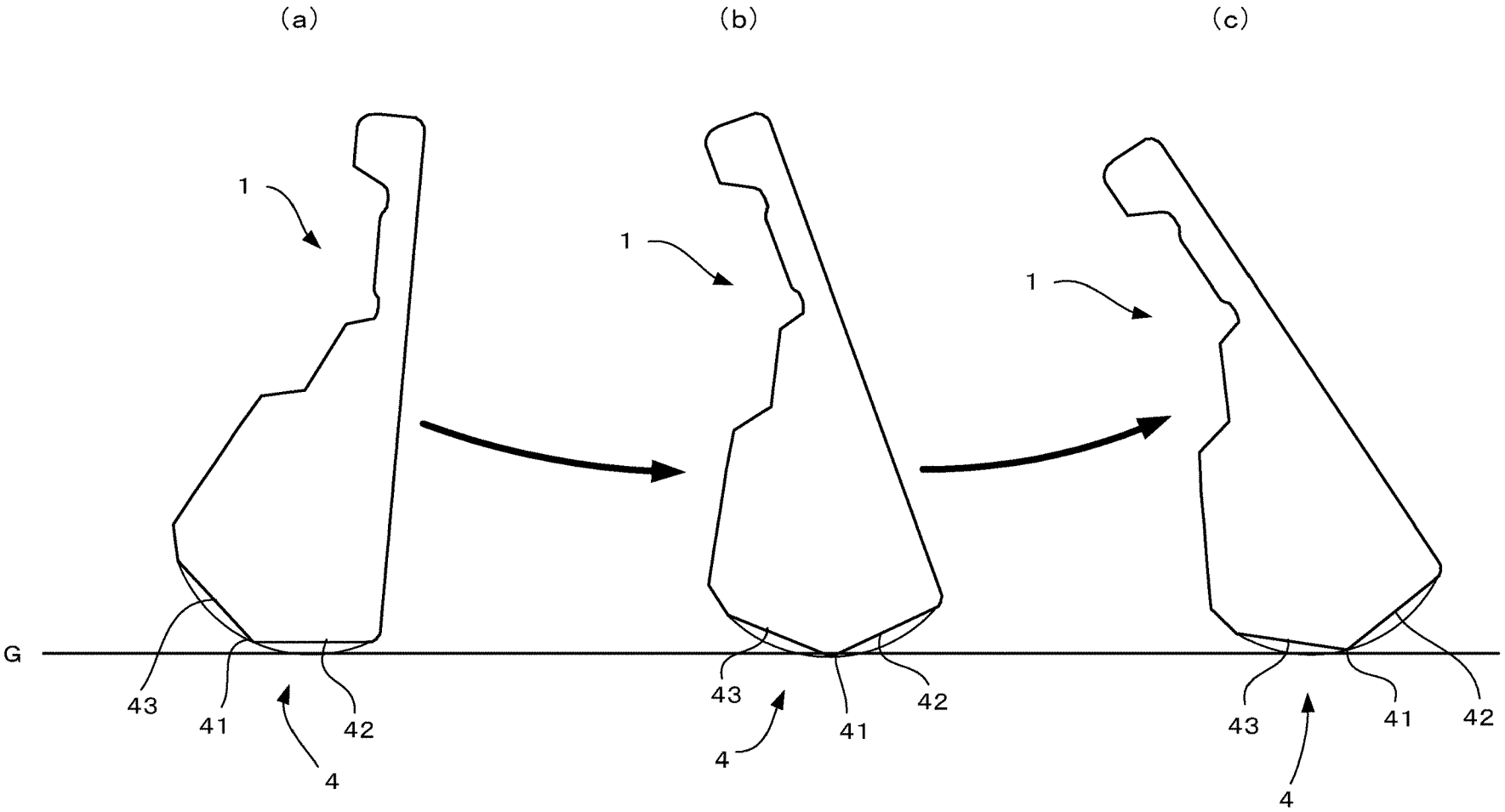
FIG. 4 is a schematic cross-sectional view showing a swing trajectory of the golf club head of FIG. 1 near the ground.
Figure 5:
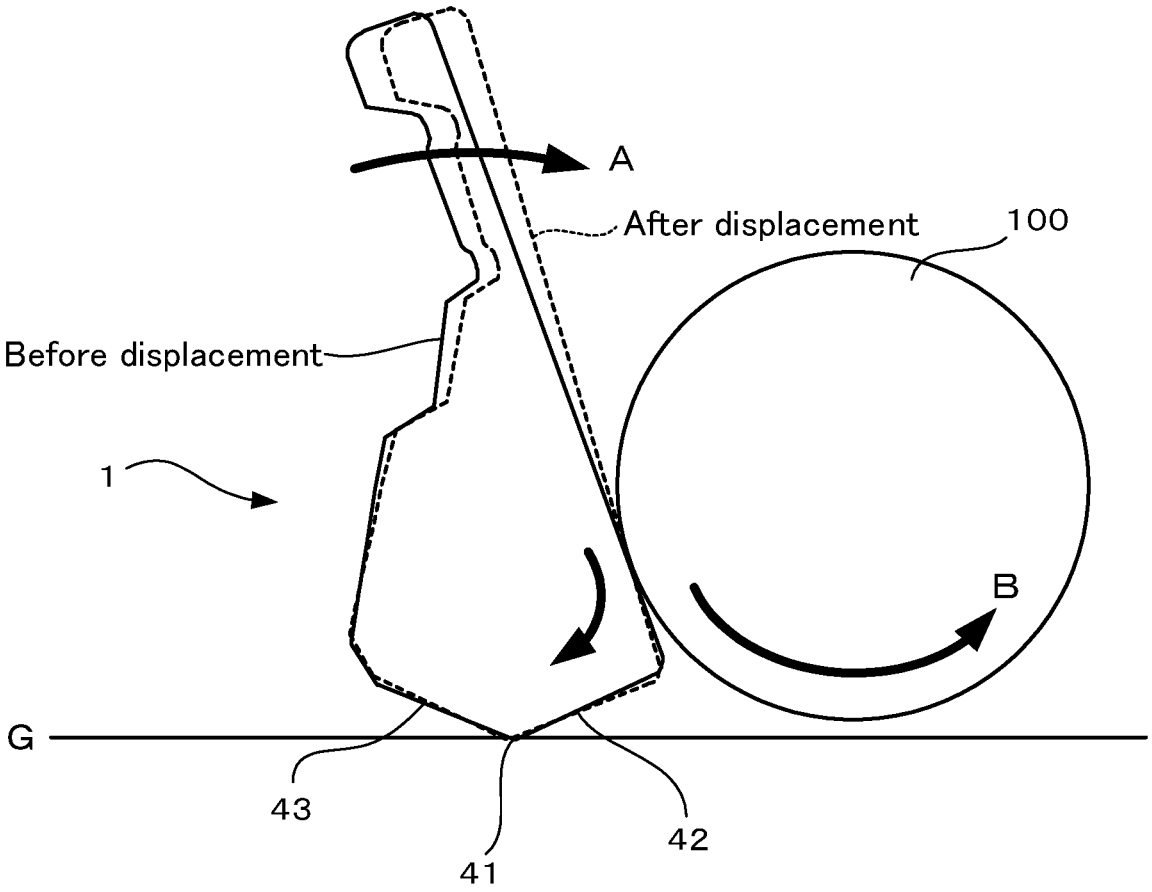
FIG. 5 is a schematic cross-sectional view illustrating a gear effect.

Next, the features of the iron-type golf club head having the above configuration will be described, with reference to FIGS. 4 and 5. FIG. 4 is a schematic cross-sectional view showing the swing trajectory of this golf club head near the ground, and FIG. 5 is a schematic cross-sectional view illustrating a gear effect.

A cross-sectional shape of the sole surface 4 formed by an arced convex surface is superimposed on the golf club head 1 of FIG. 4 for comparison. When the head 1 approaches the ground G during the process of the swing, the edge portion of the sole surface 4 on the face side opposes the ground G (FIG. 4(*a*)), and thereafter the apex 41 is positioned at its lowest point (FIG. 4(*b*)), before the head 1 moves away from the ground G with the edge portion on the back side opposing the ground G (FIG. 4(*c*)). In this process, the face side of the sole surface 4 contacts the ground G before the apex 41 contacts the ground G, as shown in FIG. 4(*a*), when the sole surface 4 is formed by an arced convex surface. Thus, the sole surface 4 starts receiving resistance from the ground G before the apex 41 has reached its lowest point.

On the other hand, the sole surface 4 of the present embodiment has a planar leading surface 42 formed from the apex 41, and, unlike the convex surface, this leading surface 42 does not protrude toward the ground G. Thus, contact with the ground is reduced compared with the convex surface, as shown in FIG. 4(*a*), enabling resistance with the ground G to be reduced. As a result, a decrease in swing speed can be suppressed. Also, with the sole surface 4 of the present embodiment, a gear effect occurs at once here when the swing proceeds, since resistance from the ground G is received mostly at the apex 41, as shown in FIG. 4(*b*). That is, as shown in FIG. 5, when resistance is received from the ground G with the apex 41 of the sole surface 4, the head 1 is displaced in the direction of arrow A in FIG. 5, such that the loft angle decreases (the position after displacement is shown with a dotted line). This displacement results in strong backspin B being imparted to a ball 100, and an increased amount of backspin of the ball 100. Note that, as shown in FIG. 5, the ball 100 is hit below a center of gravity 50 of the head 1, resulting in the head 1 being displaced and enabling a gear effect to be obtained in the direction of arrow A.

On the other hand, backspin can also be imparted in the case where the sole surface 4 is a convex surface, but since the convex surface is already receiving resistance on the face side of the apex 41 before the apex 41 contacts the ground G, as noted above, the resistance received by the sole surface 4 is distributed. Accordingly, the amount of backspin that is imparted to the ball 100 is extremely small, compared with the case where resistance is received at once by the apex 41, as with the head 1 of the present embodiment. Since swing speed could also possibly decrease because of resistance due to the convex surface being received, an increase in the amount of backspin can also not be expected for this reason.

Also, after the apex 41 of the sole surface 4 has passed beyond the ground G, the trailing surface 43 opposes the ground G, as shown in FIG. 4(*c*), and since the trailing surface does not protrude toward the ground G, similarly to the leading surface 41, the resistance received from the ground G is reduced. As a result, a reduction in swing speed when swinging the club through the ball can be prevented, and low-drag performance can be improved.

To summarize the above effects, according to the present embodiment, a boundary line 41 extending in the toe-heel direction is provided as the apex on the sole surface 4, and a leading surface 42 sloping planarly to the face side and a trailing surface 43 sloping planarly to the back side are formed with this boundary line 41 sandwiched therebetween. Since these surfaces do not protrude toward the ground G, the resistance that is received from the ground G during the swing can be reduced, as compared with a sole surface that is constituted by an arced convex surface. As a result, a decrease in swing speed can be prevented, and low-drag performance can also be improved. Also, since the leading surface 42 tends not to receive resistance from the ground, the resistance can be received mostly at the apex 41. Thus, as noted above, a gear effect can be produced at once, and the amount of backspin of the ball 100 can be increased.

3. Golf Club Set

Figure 6:
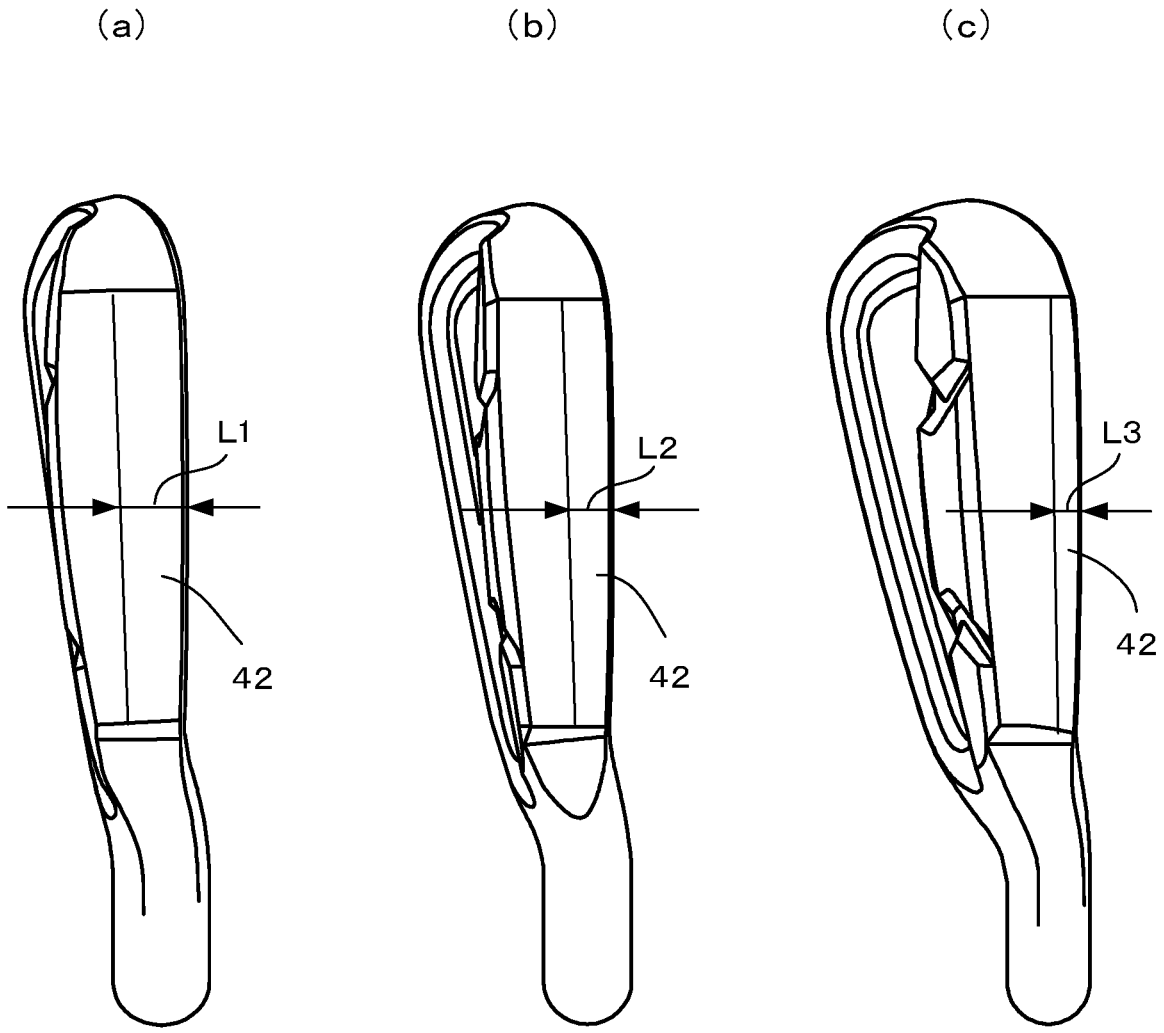
FIG. 6 are bottom views showing golf clubs of a golf club set according to the present invention, with (a), (b) and (c) respectively being bottom views of 3, 6 and 9 iron-type golf club heads as seen from a sole surface.

Next, one embodiment of a golf club set having the above golf club head will be described. Although a 3 iron-type golf club head was taken as an example in the above embodiment, the shape of the sole surface 4 may be changed according to the loft angle of the head 1. This point will be described with reference to FIG. 6. FIG. 6 are bottom views of 3 (a), 6 (b) and 9 (c) iron-type golf club heads as seen from the sole surface.

As shown in FIG. 6, with these three golf club heads, widths L1, L2 and L3 of the leading surface 42 in the face-back direction increase, the smaller the loft angle of the golf club. That is, the width L1 of the leading surface 42 of the 3-iron is the largest, and the width L3 of the 9-iron is the smallest. For example, the width L1 of the leading surface 42 of the 3-iron can be set to 40 to 60% of the width of the sole surface 4 in plan view, and the width L2 of the leading surface 42 of the 6-iron can be set to 30 to 50%. Also, the width L3 of the leading surface 42 of the 9-iron can be set to 20 to 40% of the width of the sole surface 4 in plan view. The following effects can be obtained by thus changing the width of the leading surface according to the type of iron.

For example, when the leading surface 41 is wide in the face-back direction, the time from when the edge portion of the sole surface 4 opposes the ground G until when the apex 41 of the sole surface 4 contacts the ground G during the swing becomes longer. It thereby takes longer for the gear effect to occur during the swing. Here, because of the long contact time between the ball and the face surface 2 when the ball is hit with a golf club such as a long iron having a small loft angle (e.g., 3-iron), it preferably takes a longer time for the gear effect to occur during the swing. On the other hand, because of the short contact time between the ball and the face surface 2 when the ball is hit with a golf club such as a short iron having a large loft angle (e.g., 9-iron), it preferably takes a shorter time for the gear effect to occur during the swing. As such, with the golf club set according to the present embodiment, as noted above, the widths L1, L2 and L3 of the leading surface 42 in the face-back direction increase, the smaller the loft angle of the golf club. Thus, advantage is taken of the characteristics of long irons and short irons noted above, and the gear effect can be produced at an appropriate timing.

Figure 7:
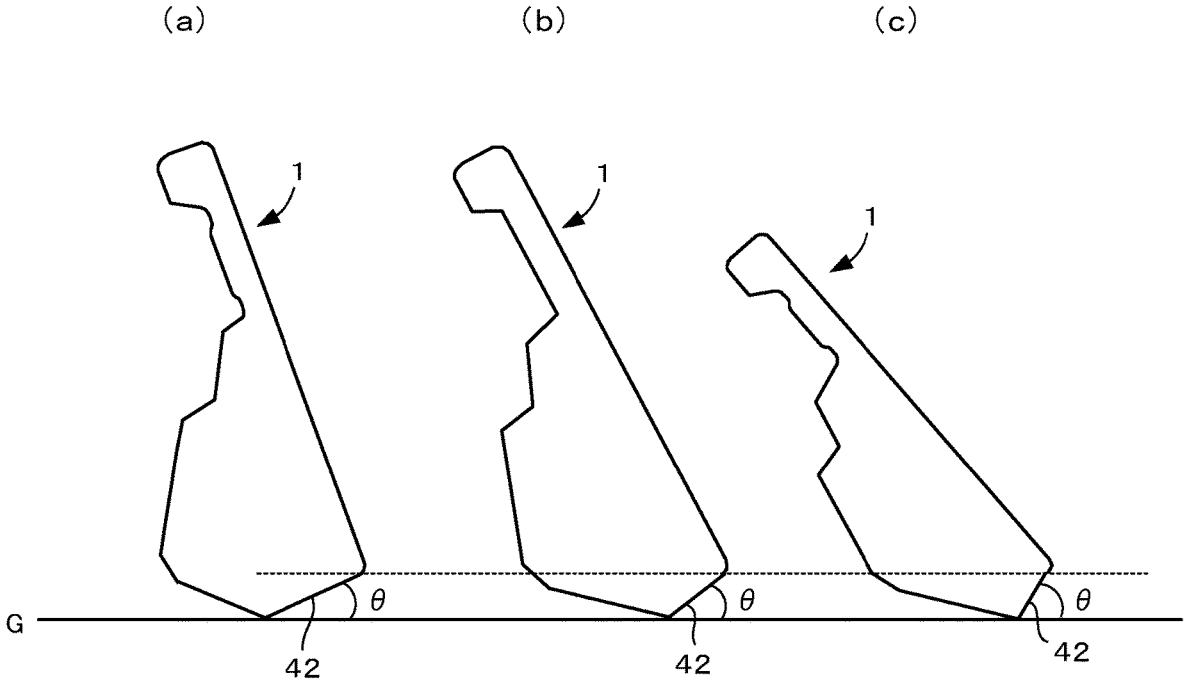
FIG. 7 are cross-sectional views of FIG. 6.

The form of the sole surface can also be configured as follows depending on the type of iron. This point will be described with reference to FIG. 7. FIG. 7 are cross-sectional views of 3 (a), 6 (b) and 9 (c) iron-type golf club heads.

Although short irons impart more backspin than long irons because of the large loft angle, a large gear effect needs to be obtained in order to realize this effect more markedly. To this end, an increased gear effect can be expected, if a large displacement of the head 1 such as shown in FIG. 5 occurs when the apex 41 of the sole surface 4 contacts the ground G. As such, in the example of FIG. 7, a configuration is adopted in which an angle θ formed by the ground G and the leading surface 42 decreases, the smaller the loft angle of the golf club such as shown in FIG. 7(*a*), in the reference state in which the golf club head is placed on the ground G. That is, the angle θ of the long iron shown in FIG. 7(*a*) is reduced and the angle θ of the short iron shown in FIG. 7(*c*) is increased. Accordingly, with short irons, the displacement of the head 1 in a direction that reduces the loft angle can be increased, since this angle θ is large. Therefore, a high gear effect can be obtained, and the amount of backspin can be increased while suppressing the launch angle.

Also, with short irons, the travel distance of the head when contacting the ball is short, and thus when the leading surface 42 is too wide, variation in head displacement could possibly occur depending on the angle of incidence and the head speed. As such, with short irons, narrowing the leading surface 42 enables the initial conditions (e.g., launch angle, amount of spin) of a shot to be stabilized and ballooning to be prevented.

On the other hand, with long irons, the travel distance of the head when contacting the ball is long, and thus the effects resulting from the boundary line 41 are obtained even when the leading surface 42 is wide. Accordingly, reduction of the launch angle can be suppressed by setting the boundary line 41 toward the back side. Even if, however, the boundary line 41 is set on the face side, reduction of the launch angle can be suppressed by reducing head displacement (by not increasing the angle θ with the ground).

4. Variations

Although one embodiment of the present invention has been described above, the present invention is not limited to the above embodiment, and various modifications can be made without departing from the spirit of the invention.

4.1

Figure 8:
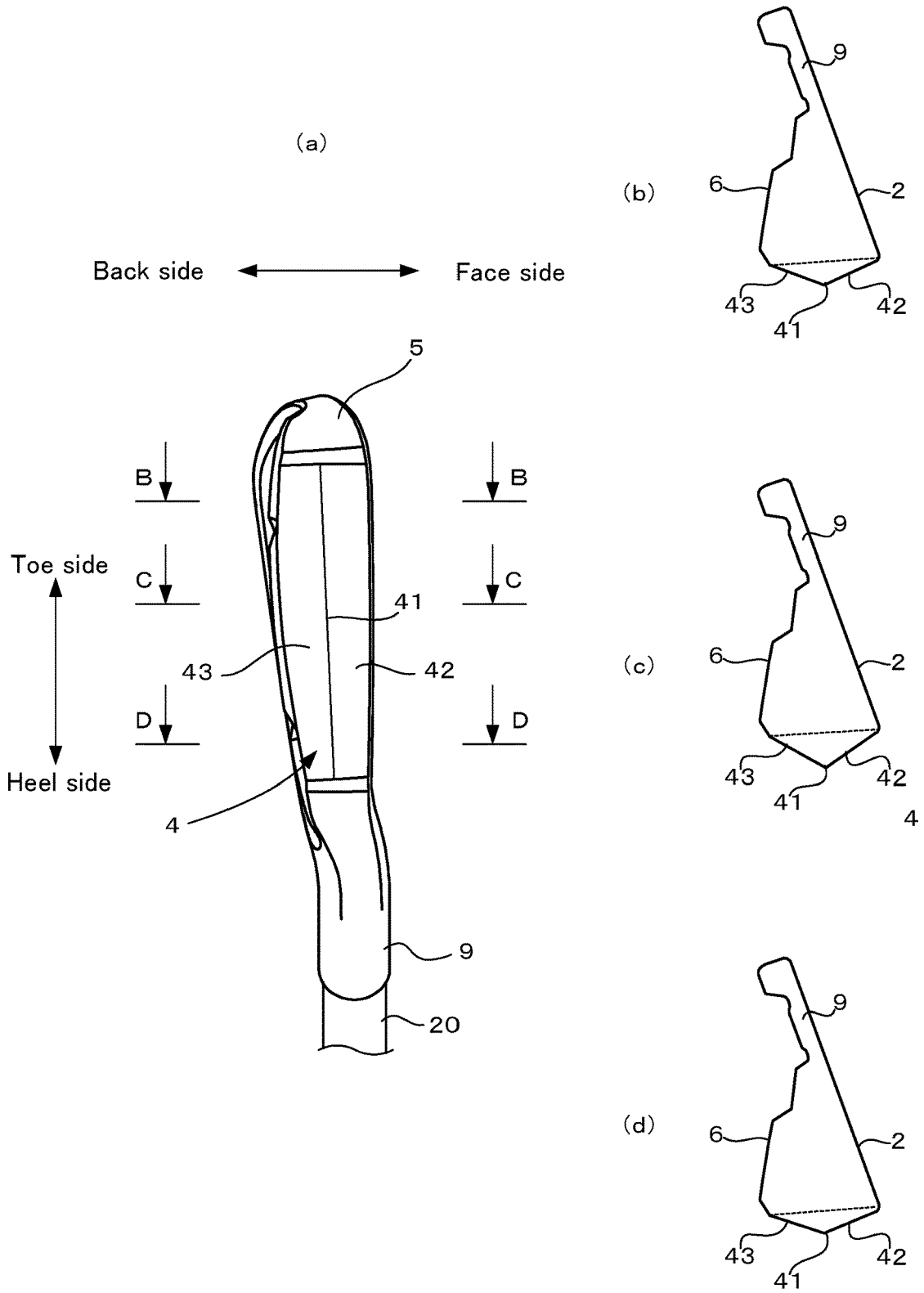
FIG. 8 are (a) a bottom view of another head according to the present invention as seen from the sole side, (b) a cross-sectional view along a line B-B of FIG. 8(*a*), (*c*) a cross-sectional view along a line C-C of FIGS. 8(*a*), and (*d*) a cross-sectional view along a line D-D of FIG. 8(*a*).

For example, in the above embodiment, the protruding height of the apex is uniform in the toe-heel direction, but this height may be varied, as shown in FIG. 8, for example. FIG. 8(*a*) is a bottom view of the head as seen from the sole side, FIG. 8(*b*) is a cross-sectional view along a line B-B of FIG. 8(*a*), FIG. 8(*c*) is a cross-sectional view along a line C-C of FIG. 8(*a*), and FIG. 8(*d*) is cross-sectional view along a line D-D of FIG. 8(*a*).

As shown in FIG. 8, in this example, the protruding height of the apex 41 is configured to be highest at a central portion of the sole surface 4 in the toe-heel direction (FIG. 8(*c*)), and the protruding height of the apex 41 is configured to be lower than the central portion at edge portions on the toe side and the heel side (FIG. 8(*b*), FIG. 8(*d*)). By adopting this configuration, the above-mentioned resistance with the ground G is at a maximum in the central portion of the sole surface 4, and decreases on the toe side and the heel side. Thus, in the central portion of the sole surface 4, the gear effect is efficiently obtained because the above-mentioned resistance increases, whereas at the edge portions on the toe side and the heel side, the gear effect decreases. Thus, the user can be selective as to how he or she hits the ball. That is, when wanting to increase the amount of backspin, the user can hit the ball at the central portion of the sole surface 4, and when not wanting to increase the amount of backspin too much, the user can hit the ball at regions toward the edge portions on the toe side and the heel side. Note that the protruding height referred to here indicates the height from a line (dotted lines in FIGS. 8(*b*) to (*d*)) connecting the edge portions of the sole surface 4 on the face side and the back side.

4.2

Figure 9:
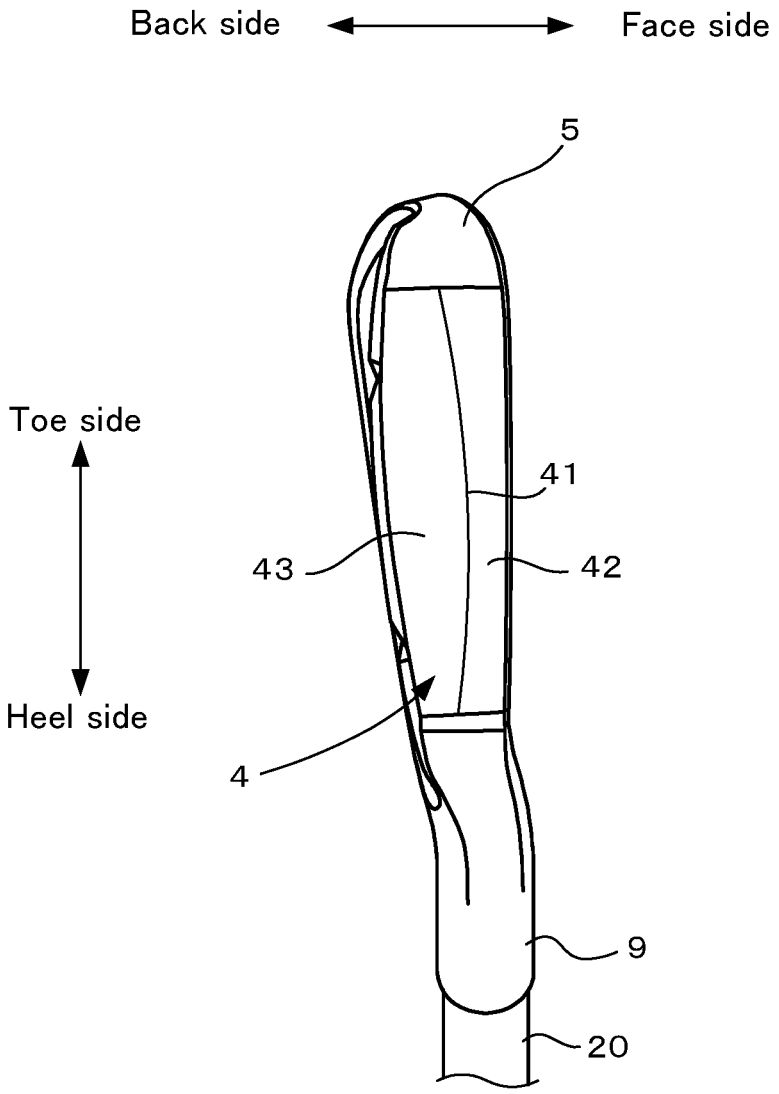
FIG. 9 is a bottom view of another head according to the present invention as seen from the sole side.

In the above embodiment, the boundary line 41 of the sole surface 4 is formed linearly, but need not necessarily be linear, and may be any line extending in the toe-heel direction. The boundary line can also be curved convexly toward the face side, as shown in FIG. 9. When the boundary line 41 is curved convexly in this way, the width of the leading surface 42 decreases in the central portion of the sole surface 4, and the width of the leading surface 42 increases on the toe side and the heel side. The following effects can thereby be obtained.

For example, when the toe drops down through impact, the face tends to open up to the right. As a result, mishits such as fading to the right and slicing tend to occur. At this time, widening the leading surface 42 on the toe side slightly compared with the central portion, as shown in FIG. 9, makes it easier to bring the toe side of the face surface 2 back by just the right amount and direct the trajectory of the ball down the middle.

On the other hand, when the hands are low at address, mishits such as drawing to the left or hooking tend to occur. At this time, widening the leading surface 42 on the heel side compared with the central portion, as shown in FIG. 9, makes it easier to bring the heel side of the face surface back by just the right amount and direct the trajectory of the ball down the middle.

Accordingly, since the width of the leading surface 42 on the toe side and the heel side increases when the boundary line 41 of the sole surface 4 is curved convexly toward the face, mishits caused by the toe down effect or low hands at address such as noted above can be corrected.

4.3

In the above embodiment, the leading surface 42 and the trailing surface 43 are formed by planar surfaces, but are not limited thereto. For example, the leading surface 42 and the trailing surface 43 need only be at least formed by sloping surfaces whose visible apex is the boundary line 41, and not by an arced convex surface spanning the entire sole surface such as shown in FIG. 4. For example, these surfaces need not be strictly planar surfaces, and need only be at least surfaces having a larger radius of curvature than the circular arc passing through the apex 41 of the sole surface 4. Alternatively, the leading surface 42 and the trailing surface 43 can also be formed with concave curved surfaces.

4.4

In the iron-type golf club head according to the present invention, as noted above, the leading surface 42 and the trailing surface 43 of the sole surface 4 need only be formed with a visible boundary line sandwiched therebetween. Accordingly, the configurations of the top surface, the toe surface, the face surface and the back surface are not particularly limited, and various modes are possible as long as a form serving as an iron-type golf club head is provided.

The invention claimed is:

1. A golf club head which comprises:

a top portion having a surface on an upper portion;

a sole portion having a surface on a bottom portion;

a hosel portion for connecting to a shaft and a heel portion both disposed on a first end of the top and sole surfaces;

a toe portion have a surface that disposed on a second end of the top and sole surfaces opposite from the heel portion;

a face portion for hitting a golf ball which has a surface defined by a first side of the top, sole, heel and toe portions, the face surface having a slope that defines a predetermined loft angle; and a back portion disposed opposite of the face portion which has a surface defined by a second side of the top, sole, heel and toe portions, wherein the sole surface includes a leading surface perpendicular to the face portion that is planar and extends rearward from the face portion so as to terminate at a boundary line, and a trailing surface that is planar, and slopes upward from the boundary line and rearward towards the back portion, the boundary line being visible and extending linearly along the face portion sole side, as well as substantially along an entire toe-heel direction as an apex, the distance between the boundary line and the face portion sole edge is substantially constant; and in a reference state in which the golf club head boundary line is placed on a planar surface in order to achieve a predetermined loft angle, the placement of the boundary line on the planar surface results in no contact to the planar surface by the leading surface or the trailing surface.

2. The iron-type golf club head according to claim 1, wherein, in a cross-sectional view between the face portion and the back portion, the sole surface peaks at the boundary line.

3. The iron-type golf club head according to claim 1, wherein, in a cross-sectional view between the face portion and the back portion, the leading surface radius of curvature and the trailing surface radius of curvature are both larger than a radius of curvature of a circular arc passing through the apex of the sole surface.

4. The iron-type golf club head according to claim 3, wherein, in a cross-sectional view between the face portion and the back portion, the radius of curvature of the leading surface is a radius of a circular arc passing through an edge of the leading surface on the face portion side and the apex, the radius of curvature of the trailing surface is a radius of a circular arc passing through an edge of the trailing surface on the back portion side and the apex, and the radius of curvature of a circular arc passing through the apex of the sole surface is a circular arc passing through the edge of the leading surface on the face portion side and the apex, the apex, and the edge of the trailing surface on the back portion side.

5. A golf club set comprising three or more golf clubs that have different loft angles and include a golf club head, wherein the golf club head comprises:

a top portion having a surface on an upper portion;

a sole portion having a surface on a bottom portion;

a hosel portion for connecting to a shaft and a heel portion both disposed on a first end of the top and sole surfaces;

a toe portion have a surface that disposed on a second end of the top and sole surfaces opposite from the heel portion;

a face portion for hitting a golf ball which has a surface defined by a first side of the top, sole, heel and toe portions, the face surface having a slope that defines a prescribed loft angle; and a back portion disposed opposite of the face portion which has a surface defined by a second side of the top, sole, heel and toe portions, wherein the sole surface includes a leading surface perpendicular to the face portion that is planar and extends rearward from the face portion so as to terminate at a boundary line, and a trailing surface that is planar, and slopes upward from the boundary line and rearward towards the back portion, the boundary line being visible and extending linearly along the face portion sole side, as well as substantially along an entire toe-heel direction as an apex, the distance between the boundary line and the face portion sole edge is substantially constant;

in a reference state in which the golf club head boundary line of each of the golf clubs is placed on a planar surface in order to achieve a predetermined loft angle, the placement of the boundary line on the planar surface results in no contact to the planar surface by the leading surface or the trailing surface, and as an angle formed by the planar surface and the leading surface of each golf club decreases, the loft angle of each golf club also decreases.

6. A golf club set according to claim 5, wherein a position of a front sole edge defined by the face portion sole side and the leading surface front side, and a position of a back trailing edge defined by the rearward termination of the trailing surface are substantially the same among each of the golf clubs.

7. A golf club set according to claim 6, wherein as the apex is formed closer to a front sole edge defined by the face portion sole side and the leading surface front side, and farther from a back trailing edge defined by the rearward termination of the trailing surface the loft angle of the golf club is increased.

8. The iron-type golf club head according to claim 5, wherein, in a reference state the golf club head of each of the golf clubs is placed on a horizontal surface, and the boundary line as the apex contacts the horizontal surface, the leading surface extending to the face portion forward from the apex is configured to reduce contact with horizontal surface during a golf swing as the golf club head approaches the reference state and the trailing surface extending to the back portion rearward from the apex is configured to reduce contact with horizontal surface during a golf swing as the golf club head passes the reference state.

9. The golf club set according to claim 5, wherein as the leading surface width in a direction from the face portion rearward towards the back portion increases, the loft angle of the golf club decreases.

10. The golf club set according to claim 9, wherein the golf club set is classified into at least three classifications that include:

a golf club having the leading surface width set to 40 to 60% of the sole surface width in a direction from the face portion rearward towards the back portion, a golf club having the leading surface width set to 30 to 50% of the sole surface width in the direction from the face portion rearward towards the back portion, and a golf club having the leading surface width set to 20 to 40% of the sole surface width in the direction from the face portion rearward towards the back portion.

11. The golf club set according to claim 10, wherein one of the golf clubs having the leading surface width set to 40 to 60% of the sole surface width is a 3-iron, one of the golf clubs having the leading surface width set to 30 to 50% of the sole surface width is a 6-iron, and one of the golf clubs having the leading surface width set to 20 to 40% of the sole surface width is a 9-iron.

* * * * *